US007451971B2

(12) United States Patent
Ikeda

(10) Patent No.: US 7,451,971 B2
(45) Date of Patent: Nov. 18, 2008

(54) SHEET FEED DEVICE AND IMAGE FORMATION DEVICE

(75) Inventor: Akihiro Ikeda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 419 days.

(21) Appl. No.: 11/211,630

(22) Filed: Aug. 26, 2005

(65) Prior Publication Data

US 2006/0071387 A1 Apr. 6, 2006

(30) Foreign Application Priority Data

Aug. 27, 2004 (JP) ..... 2004-248494

(51) Int. Cl.
*B65H 83/00* (2006.01)

(52) U.S. Cl. ..... 271/3.14; 271/145; 271/163

(58) Field of Classification Search ..... 271/186, 271/184, 3.14, 145, 163
See application file for complete search history.

(56) References Cited

U.S. PATENT DOCUMENTS 5,980,137 A 11/1999 Yano et al.
6,019,362 A 2/2000 Yazawa
2005/0200071 A1* 9/2005 Ikeda ..... 271/121
2005/0275155 A1* 12/2005 Horiba ..... 271/145

FOREIGN PATENT DOCUMENTS

JP 10-194552 7/1998
JP 10194552 7/1998

* cited by examiner

*Primary Examiner*—Kaitlin S Joerger
(74) *Attorney, Agent, or Firm*—Banner & Witcoff, Ltd.

(57) ABSTRACT

A sheet feed device has a sheet supply tray in which sheets to be fed are stored, a roller mechanism which ejects each printed sheet on to a sheet holding part, and a cover member which is placed between a sheet supply side on which each sheet is fed before printing and a sheet ejection side on which each sheet is fed after printing. In the sheet feed device, each sheet supplied from the sheet supply tray changes its sheet feed direction approximately 180 degrees before being ejected to the sheet holding part. Part of the cover member on the sheet holding part's side is provided with a first projecting part which lets the ejected sheets be held in the sheet holding part while being bent substantially in an S-shape.

16 Claims, 9 Drawing Sheets

FIG.9C
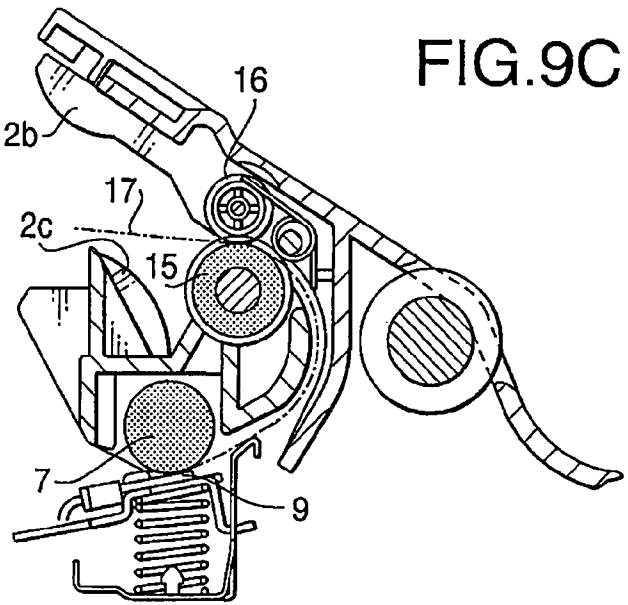
FIG.9B
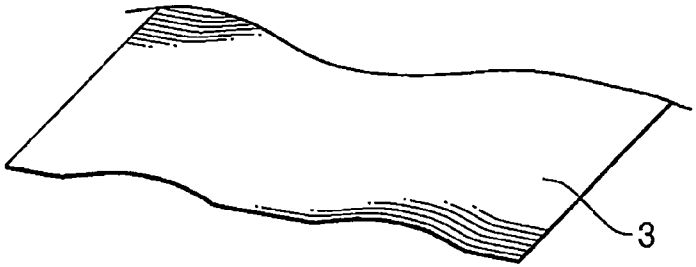
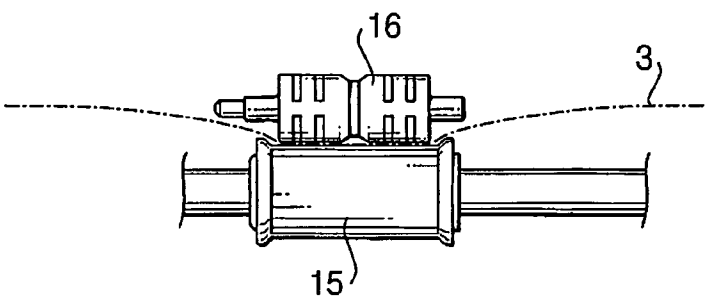
FIG.9A

SHEET FEED DEVICE AND IMAGE FORMATION DEVICE

INCORPORATION BY REFERENCE

This application claims priority from Japanese Patent Application No. 2004-248494, filed on Aug. 27, 2004, the entire subject matter of which is incorporated herein by reference thereto.

BACKGROUND OF THE INVENTION

Aspects of the present invention relate to a sheet feed device employed for facsimile machines, copiers, printers, etc. for feeding sheets (e.g., paper, OHP sheets, labels, etc.), and in particular, to a sheet feed device in which each sheet supplied from a sheet supply tray changes its sheet feed direction approximately 180 degrees before being ejected to a sheet holding part.

Sheet feed devices for feeding sheets (e.g., paper, OHP sheets, labels, etc.) are widely employed for facsimile machines, copiers, printers, etc. In sheet feed devices in which each sheet supplied from a sheet supply tray changes its sheet feed direction approximately 180 degrees before being ejected to a sheet holding part, the sheet supply tray and the sheet holding part are generally separated from each other by a sheet feed cover. An example of such a configuration is disclosed in Japanese Patent Provisional Publication No. HEI 10-194552.

However, even in sheet feed devices having such a sheet feed cover for separating the sheet supply tray and the sheet holding part from each other, the separation is not perfect and there is a high probability that an upper part of a sheet set in the sheet supply tray will make contact with an upper part of a sheet held in the sheet holding part.

Therefore, when the sheet set in the sheet supply tray is fed to a position between a printing head and a platen, the upper part of a stack of sheets held in the sheet holding part can be pulled downward together with the sheet in the sheet supply tray (due to friction between the contacting parts of the sheets) and the stack of sheets held in the sheet holding part can curve downward to cover a sheet ejecting part and flop toward an operation panel.

It is possible to resolve the problem by sufficiently enlarging the sheet feed cover and perfectly separating the sheets set in the sheet supply tray from the sheets held in the sheet holding part. However, such an approach causes an increase in the size of the sheet feed device and the facsimile machine, etc.

SUMMARY

Aspects of the present invention, which have been made in consideration of at least one of the above problems, are advantageous in that a sheet feed device capable of preventing the sheets held in the sheet holding part from curving downward and flopping can be provided while realizing downsizing of the device.

BRIEF DESCRIPTION OF THE ACCOMPANYING DRAWINGS

FIG. 9A is a front view showing the roller mechanism of the facsimile machine of the illustrative embodiment of FIG. 1 and a sheet sandwiched between a sheet ejection roller and a sheet ejection pinch roller of the roller mechanism.

FIG. 9B is a perspective view showing a sheet being ejected from the roller mechanism.

FIG. 9C is an enlarged view showing a part of the facsimile machine of the illustrative embodiment around the roller mechanism.

DETAILED DESCRIPTION

Figure 1:
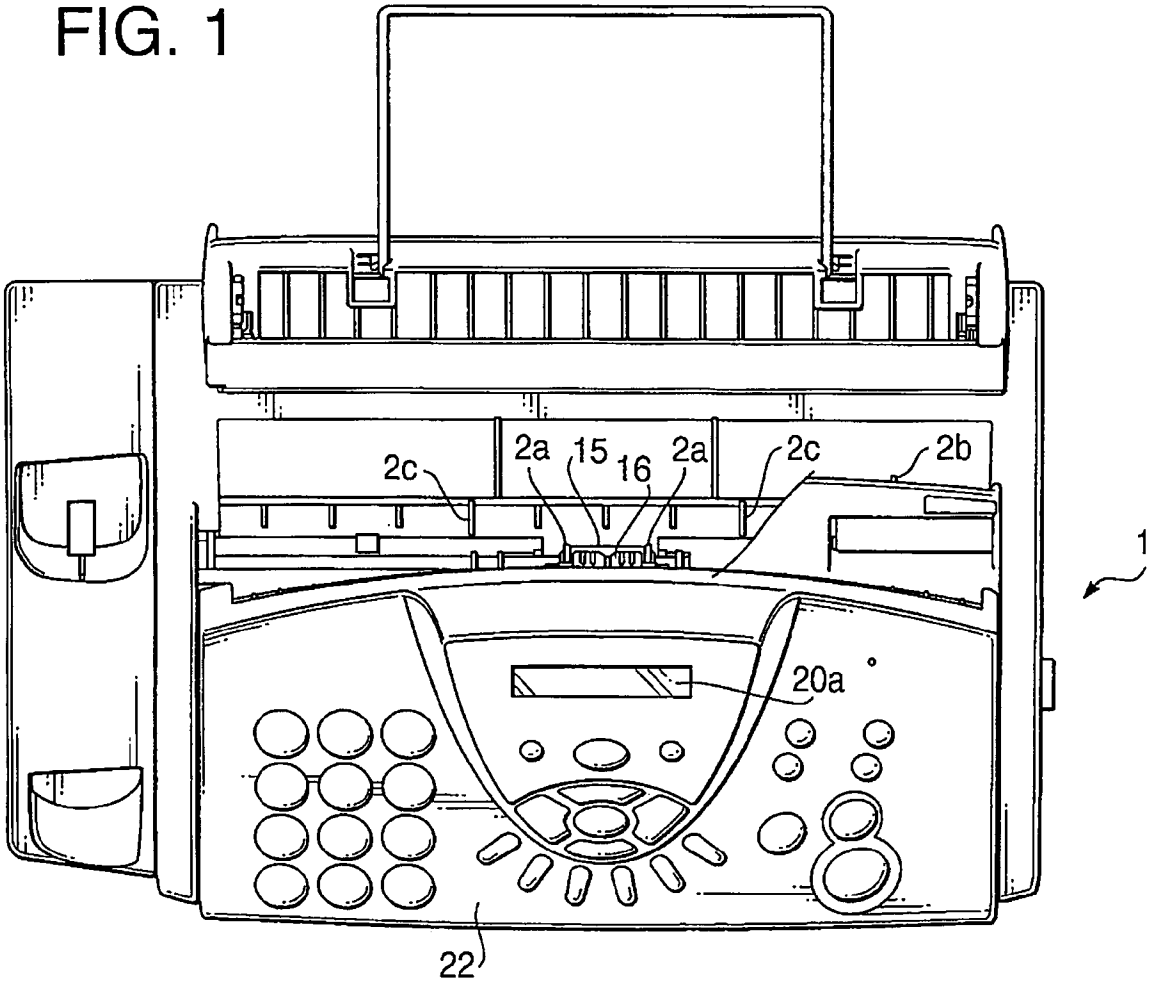
FIG. 1 is a top view of a facsimile machine employing a sheet feed device in accordance with an illustrative embodiment of the present invention.

It is noted that various connections are set forth between elements in the following description. It is noted that these connections in general and unless specified otherwise, may be direct or indirect and that this specification is not intended to be limiting in the respect.

General Overview

In accordance with an aspect of the present invention, there is provided a sheet feed device comprising a sheet supply tray in which sheets to be fed are stored, a roller mechanism which ejects each sheet after being printed on to a sheet holding part, and a cover member which is placed between a sheet supply side on which each sheet is fed before printing and a sheet ejection side on which each sheet is fed after printing. In the sheet feed device, each sheet supplied from the sheet supply tray changes its sheet feed direction approximately 180 degrees before being ejected to the sheet holding part. Part of the cover member on the sheet holding part's side is provided with a first projecting part which lets the ejected sheets be held in the sheet holding part while being bent substantially in an S-shape.

By the above configuration, the ejected sheets are held in the sheet holding part while being bent substantially in an S-shape. Therefore, even when downward force is applied to the upper part of a stack of sheets held in the sheet holding part, the stack of sheets is not deformed like an arch as in ordinary buckling and only the part already bent in the S-shape is deformed to bend further.

Also in the sheet feed device according to aspects of the present invention, the upper part of the stack of sheets held in the sheet holding part can be pulled downward together with a sheet set in the sheet supply tray (due to friction between contacting parts of the sheets) when the sheet in the sheet supply tray is fed downward. However, since only the part of the stack of sheets (held in the sheet holding part) already bent in the S-shape is deformed to bend further in such cases as mentioned above, the stack of sheets in the sheet holding part is prevented from curving downward like an arch and flopping even when the sheet feed cover is downsized.

Incidentally, in sheet feed devices in which each sheet supplied from the sheet supply tray changes its sheet feed direction approximately 180 degrees before being ejected to the sheet holding part, after being printed on each sheet tends to curl when, the sheet is ejected from the ejecting part of the roller mechanism. In such sheet feed devices, the curl in the sheet is removed generally by causing a reverse curl in the sheet by letting the sheet (being ejected from the ejecting part) collides with the cover member.

In order to remove the curl sufficiently, it is desirable to sufficiently enlarge the cover member so that a reverse curl can be continuously caused in the sheet during a period between the collision of the front end of the sheet with the cover member and the completion of the sheet ejection.

Therefore, downsizing the cover member generally makes it difficult to remove the curl in the sheet sufficiently (since it becomes impossible to continuously cause the reverse curl in the sheet during the period between the collision of the front end of the sheet with the cover member and the completion of the sheet ejection).

However, in the present invention, a sufficient reverse curl can be caused in the sheet (differently from cases where no first projecting part is provided) since the reverse curl is caused in the sheet not only by the cover member but also by the first projecting part. Therefore, it becomes possible to remove the curl in the sheet securely while downsizing the cover member.

As above, by the sheet feed device in accordance with aspects of the present invention, the curl in each sheet ejected from the roller mechanism can be eliminated and the sheets held in the sheet holding part can be prevented from curving downward like an arch and flopping, while realizing the downsizing of the sheet feed device.

Further, the whole sheet feed device including the cover member can be designed with high flexibility since the first projecting part is provided to part of the cover member.

By providing the first projecting part to part of the cover member as above, larger internal space of the sheet holding part can be secured compared to other cases (e.g. where the whole cover member is raised for implementing an equivalent of the first projecting part). Therefore, even when a sheet gets jammed in the sheet holding part, the user can easily remove the jammed sheet by reaching a hand into the sheet holding part, by which high maintainability is realized.

By the way, when a sheet set in the sheet supply tray is fed, the stack of already-ejected sheets held in the sheet holding part can be dragged downward by the fed sheet and thereby bend like an arch making contact with an opposing surface facing the first projecting part as mentioned above.

Meanwhile, a sheet being ejected from the roller mechanism has to pass between the stack of already-ejected sheets held in the sheet holding part and the opposing surface facing the first projecting part. However, when the stack of already-ejected sheets bending like an arch is pressing against the opposing surface as above, a strong frictional drag hampers the sheet from being ejected between the stack of arched sheets and the opposing surface, by which the sheet can get stuck in the sheet holding part (paper jam).

To avoid the problem, in an illustrative embodiment, part of an opposing part opposite to (facing) the first projecting part is provided with a second projecting part projecting toward the cover member, and an apex of the second projecting part is placed above the ejecting part (defined as a point of contact of the sheet with the roller mechanism that is the most downstream in the sheet feed direction) and below an apex of the first projecting part.

By the above configuration, even when the stack of already-ejected sheets held in the sheet holding part bends as above, the stack bends without contacting the whole opposing part but contacting the apex of the second projecting part. Therefore, the sheet being ejected from the roller mechanism is ejected through a gap formed between the stack of already-ejected sheets held in the sheet holding part and the opposing part having the second projecting part.

Since the second projecting part is provided to part of the opposing part, the frictional drag during the ejection of each sheet to the sheet holding part gets smaller compared to the case where the stack of arched sheets presses against the whole opposing part, by which each sheet can be ejected to the sheet holding part smoothly.

The second projecting part may be placed at a position shifted from the roller mechanism substantially in an axial direction of the roller mechanism when seen from the apex of the first projecting part in the sheet feed direction.

By the above configuration, the roller mechanism has no obstacle (applying a frictional drag or feeding resistance to the sheet being ejected) in the direction of the feeding force applied to the sheet (i.e. on a line directly extending from the roller mechanism in the sheet feed direction). Therefore, the feeding force of the roller mechanism is utilized efficiently and the sheet can be ejected securely.

The second projecting parts may be placed on both sides of the roller mechanism in the axial direction of the roller mechanism when seen from the apex of the first projecting part in the sheet feed direction.

By the above configuration, a rotation moment occurring at a contacting part of one second projecting part on one side of the roller mechanism due to feeding resistance can be canceled by a rotation moment occurring at a contacting part of another second projecting part on the other side of the roller mechanism due to feeding resistance. Therefore, the sheet being ejected from the roller mechanism is prevented from being ejected obliquely (deviating from the line directly extending from the roller mechanism in the sheet feed direction).

The second projecting part may be placed on a downstream side of the roller mechanism in the sheet feed direction and on an upstream side of the first projecting part in the sheet feed direction.

Incidentally, if the stack of sheets held in the sheet holding part bends, the surface of the stack of sheets facing the ejecting part might become substantially orthogonal to the direction of sheet ejection from the ejecting part. In such cases, the sheet being ejected from the ejecting part is likely to head for a base part of the sheet holding part and result in a paper jam.

To avoid the problem, in an illustrative embodiment, the base part of the sheet holding part is placed below the ejecting part, and the basal part of the sheet holding part is provided with a holding position adjusting member which adjusts the position of the stack of sheets held in the sheet holding part so that each sheet ejected from the ejecting part and colliding with the stack of sheets will head upward.

By the above configuration, the sheet ejected from the ejecting part and colliding against the surface of the stack of sheets (held in the sheet holding part) facing the ejecting part can securely be guided upward inside the sheet holding part, by which the sheet ejected from the ejecting part is securely prevented from heading for the base part of the sheet holding part and resulting in a paper jam.

In the above configuration, the holding position adjusting member may adjust the position of the stack of sheets held in the sheet holding part so that each sheet ejected from the ejecting part and colliding against the stack of sheets will head upward, by adjusting the position of the bottom of the stack of sheets held on the base part of the sheet holding part toward the ejecting part.

The holding position adjusting member may be implemented by a third projecting part protruding from part of the base part of the sheet holding part.

By the above configuration, the holding position adjusting member can be provided to the base part of the sheet holding part with ease, while increasing the flexibility of design of the whole device.

Further, since the holding position adjusting member is implemented by the third projecting part protruding from part of the base part of the sheet holding part, larger internal space of the sheet holding part can be secured compared to other cases (e.g. where the holding position adjusting member is formed by raising the whole base part of the sheet holding part). Therefore, a paper jam in the sheet holding part can be prevented without requiring excessive maintenance, allowing the user to easily remove a jammed sheet by reaching a hand into the sheet holding part even in case of a paper jam.

According to some aspects of the invention, the roller mechanism may include an ejection roller which is placed to make contact with the sheet and thereby apply feeding force to the sheet and a pinch guide member which is placed to oppose the ejection roller via the sheet. A circumferential exterior surface of the ejection roller for making contact with the sheet is provided with projecting parts (surrounding the whole circumference of the ejection roller) at both ends of the ejection roller in its axial direction.

By the above configuration, the sheet ejected from the roller mechanism is curved in a "V" or "U" like shape when seen in the sheet feed direction, by which stiffness of the sheet against force (terrestrial gravitation) bending the sheet around the axial direction of the roller mechanism is increased. By increasing the stiffness, the sheet being ejected from the roller mechanism is prevented from bending downward, by which the sheet is securely guided and fed upward in the sheet holding part and the paper jam can be prevented from occurring.

The pinch guide member may be implemented, for example, by a sheet ejection pinch roller which is placed to press against the ejection roller.

In accordance with another aspect of the present invention, there is provided a sheet feed device including a sheet supply tray in which sheets to be fed are stored, a roller mechanism which ejects each sheet after being printed on to a sheet holding part, and a cover member which is placed between a sheet supply side on which each sheet is fed before printing and a sheet ejection side on which each sheet is fed after printing. In the sheet feed device, each sheet supplied from the sheet supply tray changes its sheet feed direction approximately 180 degrees before being ejected to the sheet holding part. A face of the cover member on the sheet holding part's side is provided with a first projecting part which lets the ejected sheets be held in the sheet holding part while being bent substantially in an S-shape. Part of an opposing part opposite to (facing) the first projecting part is provided with a second projecting part projecting toward the cover member. An apex of the second projecting part is placed above an ejecting part, defined as a point of contact of the sheet with the roller mechanism that is the most downstream in the sheet feed direction, and below an apex of the first projecting part.

By the above configuration, the curl in each sheet ejected from the roller mechanism can be eliminated, the sheets held in the sheet holding part can be prevented from curving downward like an arch and flopping, and each sheet can be ejected to the sheet holding part smoothly, while realizing the downsizing of the sheet feed device.

Incidentally, while the first projecting part in the above configuration may be provided only to part of the face of the cover member on the sheet holding part's side (e.g. by letting part of the face protrude therefrom), the first projecting part may also be formed as a projecting surface by letting substantially all the face (of the cover member on the sheet holding part's side) project, for example.

In accordance with another aspect of the present invention, there is provided a sheet feed device including a sheet supply tray in which sheets to be fed are stored, a roller mechanism which ejects each sheet after a prescribed process to a sheet holding part, and a cover member which is placed between a sheet supply side on which each sheet is fed before the prescribed process and a sheet ejection side on which each sheet is fed after the prescribed process. In the sheet feed device, each sheet supplied from the sheet supply tray changes its sheet feed direction approximately 180 degrees before being ejected to the sheet holding part. Part of the cover member on the sheet holding part's side is provided with a first projecting part which lets the ejected sheets be held in the sheet holding part while being bent substantially in an S-shape.

In accordance with another aspect of the present invention, there is provided an image formation device including a sheet feed device including a sheet supply tray in which sheets to be fed are stored, a roller mechanism which ejects each sheet after image formation to a sheet holding part, and a cover member which is placed between a sheet supply side on which each sheet is fed before image formation and a sheet ejection side on which each sheet is fed after image formation. In the image formation device, each sheet supplied from the sheet supply tray changes its sheet feed direction approximately 180 degrees before being ejected to the sheet holding part. Part of the cover member on the sheet holding part's side is provided with a first projecting part which lets the ejected sheets be held in the sheet holding part while being bent substantially in an S-shape.

In the image formation device, part of an opposing part opposite to (facing) the first projecting part may be provided with a second projecting part projecting toward the cover member, and an apex of the second projecting part is placed above the ejecting part (defined as a point of contact of the sheet with the roller mechanism that is the most downstream in the sheet feed direction) and below an apex of the first projecting part.

The base part of the sheet holding part may be placed below the ejecting part, and the base part of the sheet holding part is provided with a holding position adjusting member which adjusts the position of the stack of sheets held in the sheet holding part so that each sheet ejected from the ejecting part and colliding against the stack of sheets will head upward.

In an illustrative embodiment, the image formation device is implemented as a facsimile machine, and a document tray for holding a document to be transmitted is provided to a face of the opposing part opposite to (facing) the second projecting part.

By the above configuration, a facsimile machine of beautiful design can be realized while reducing its size.

ILLUSTRATIVE EMBODIMENTS

Referring now to the drawings, a description will be given in detail of illustrative embodiments in accordance with the present invention.

Figure 2:
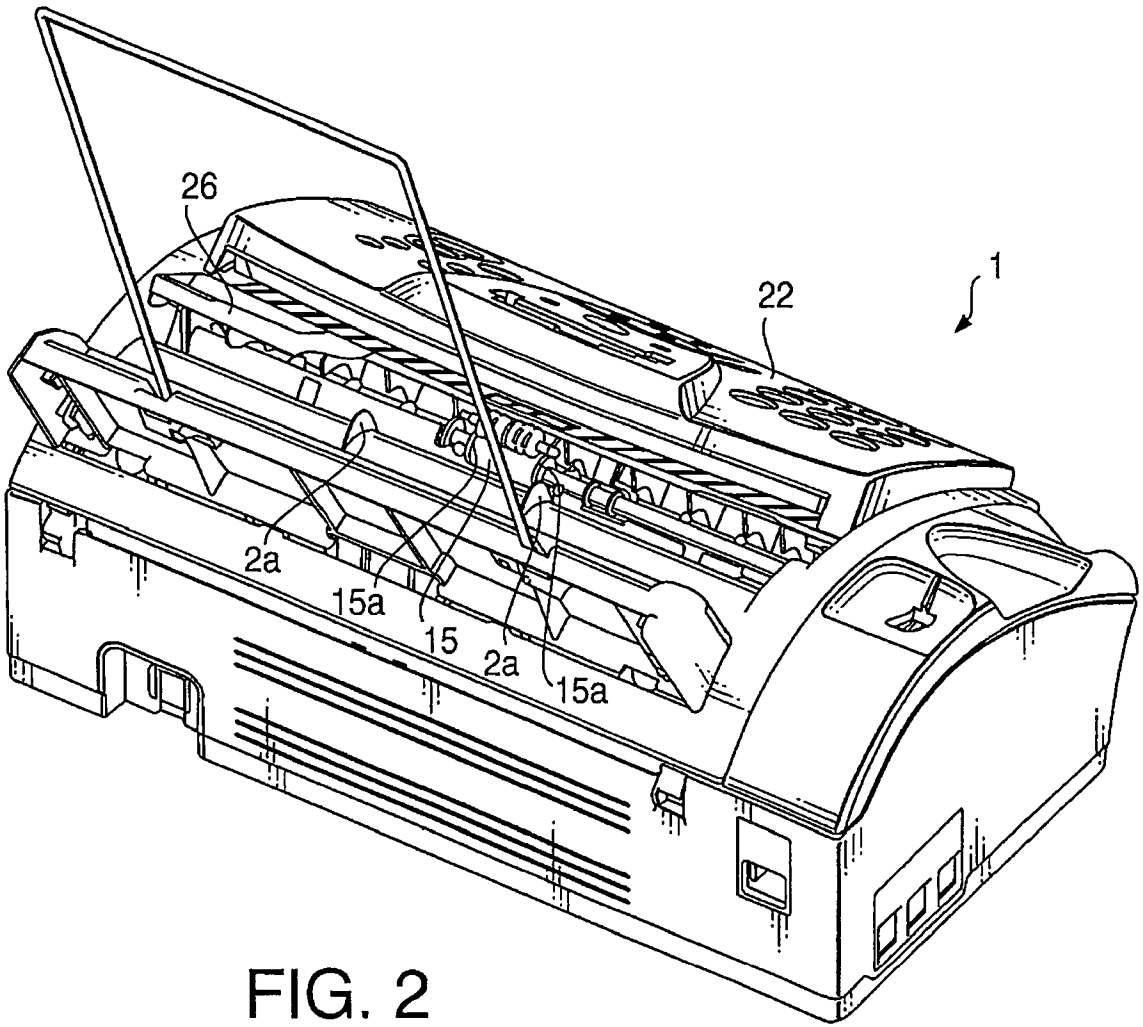
FIG. 2 is a perspective view of the facsimile machine of FIG. 1 from the rear and above.
Figure 3:
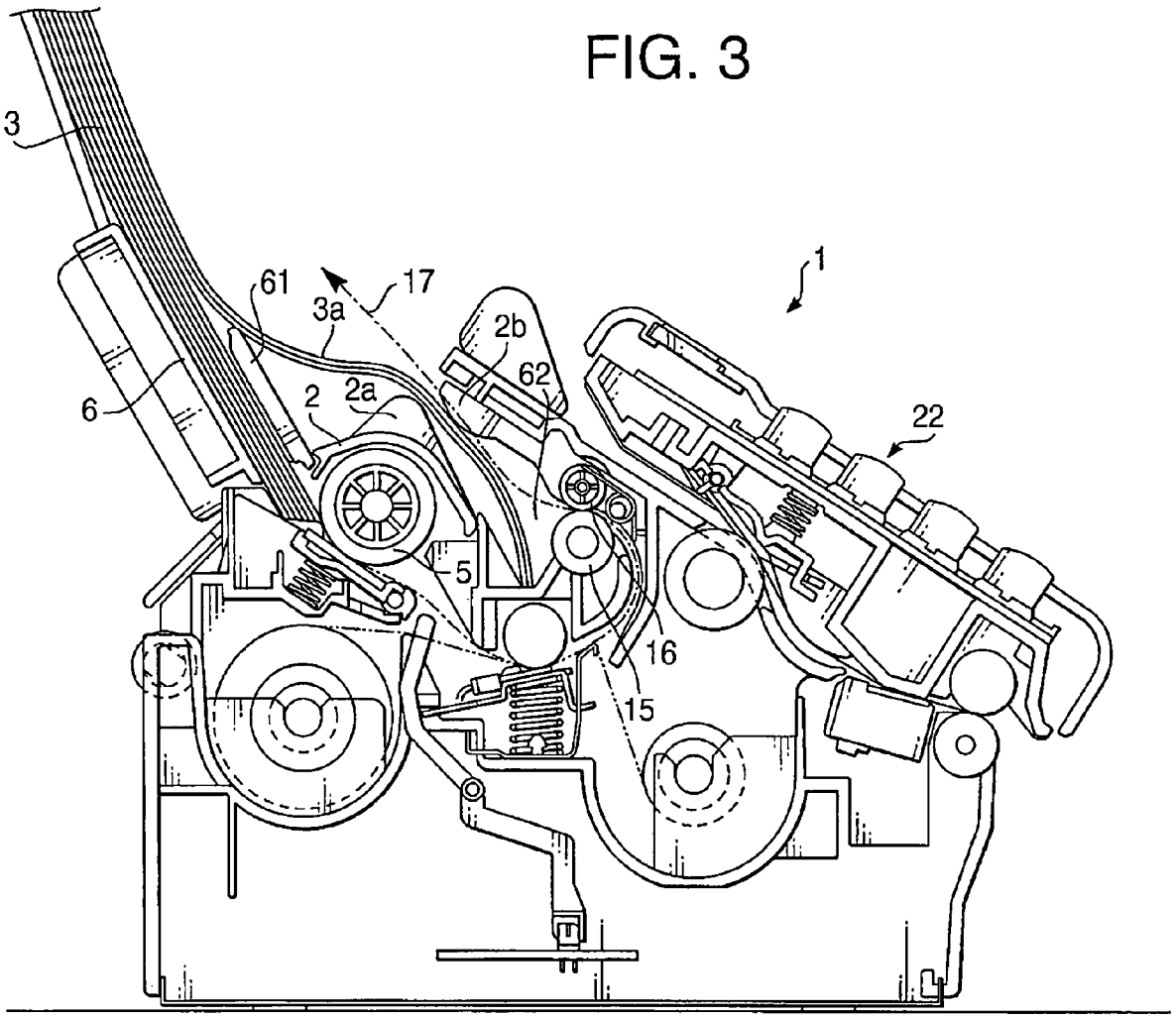
FIG. 3 is a sectional side view showing the overall composition of the facsimile machine of FIG. 1.
Figure 4:
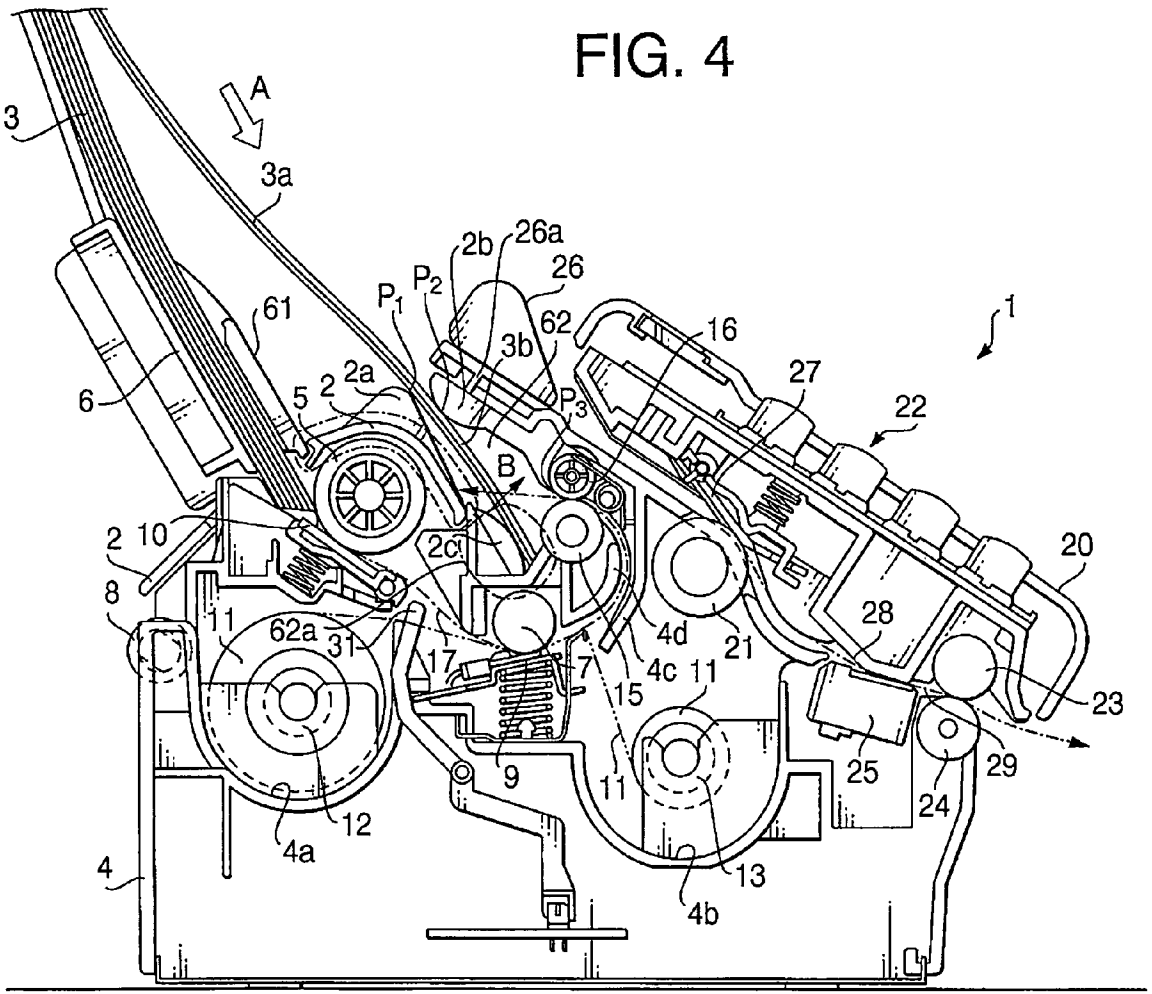
FIG. 4 is a sectional side view showing the detailed composition of the facsimile machine of FIG. 1.
Figure 5B:
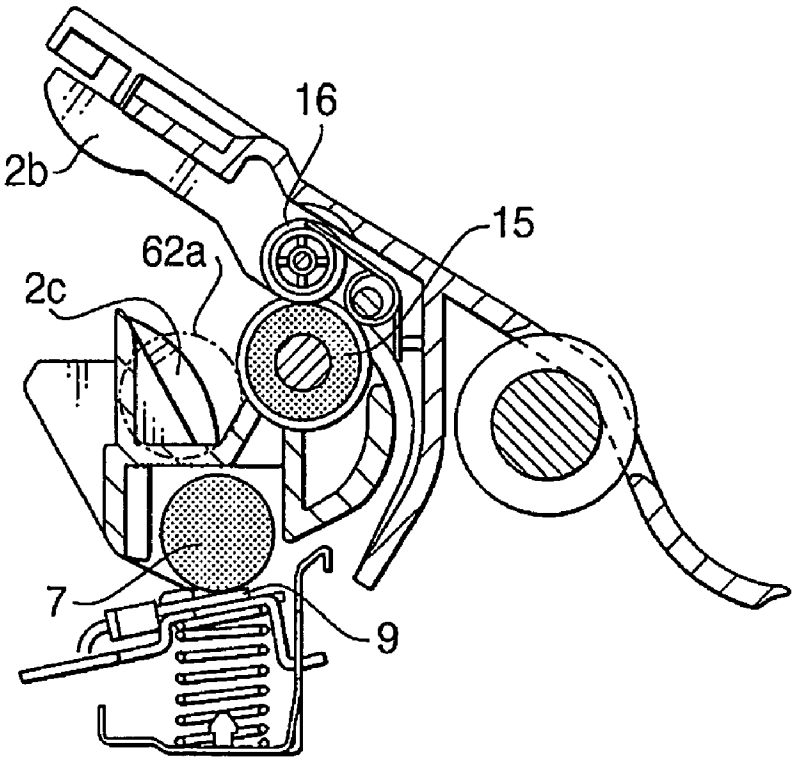
FIGS. 5A and 5B are enlarged views showing a roller mechanism of the facsimile machine of FIG. 1.
Figure 5A:
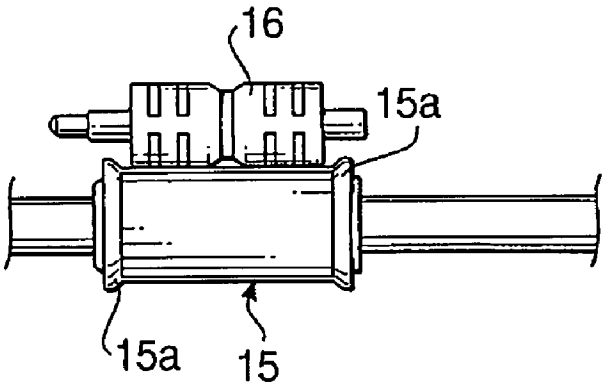

FIG. 1 is a top view of a facsimile machine 1 employing a sheet feed device in accordance with an illustrative embodiment of the present invention. FIG. 2 is a perspective view seeing the facsimile machine 1 from the rear and above. FIG. 3 is a sectional side view showing the overall composition of the facsimile machine 1. FIG. 4 is a sectional side view showing the detailed composition of the facsimile machine 1. FIGS. 5A and 5B are enlarged views showing a roller mechanism of the facsimile machine 1 which will be described later.

First, the overall composition of the facsimile machine 1 will be explained below. Referring to FIG. 4, the facsimile machine 1 of this illustrative embodiment has an upper cover 2 and a lower cover 4. In FIG. 4, the front of the facsimile machine 1 is shown on the right-hand side and the rear is shown on the left-hand side. A sheet supply tray 6 is provided to an upper-rear part of the upper cover 2, and a stack of sheets 3 as print media are set and stored in the sheet supply tray 6.

Each sheet 3 is fed along a sheet feed path 17 (indicated by a chain line arrow in FIG. 4) by rollers, etc. which will be explained later. The sheets 3 are not restricted to paper but can be various print media such as OHP sheets.

The upper cover 2 and the lower cover 4 are linked with a cover rotation shaft 8 (at the rear ends of the covers 2 and 4) to be rotatable around the cover rotation shaft 8. When a user of the facsimile machine 1 opens the upper cover 2 by operating a lever (not shown), the upper cover 2 rotates counterclockwise in FIG. 4 around the cover rotation shaft 8.

When the upper cover 2 is opened as above, various components mounted on the upper part of the facsimile machine 1 (the sheet supply tray 6, a sheet feed roller 5, a platen 7, a sheet ejection roller 15, an ADF (Automatic Document Feeder) roller 21, an LF (Line Feed) roller 23, a keyboard (operation panel) 22, etc.) also rotate around the cover rotation shaft 8 together with the upper cover 2.

The sheet feed roller 5, driven and rotated by a drive motor (not shown) and gears (not shown), feeds the sheets 3 set in the sheet supply tray 6 one by one along the sheet feed path 17 in cooperation with a regulating member 10.

On the downstream side of the sheet feed roller 5 in the sheet feed path 17, the platen 7 is placed. The platen 7 is also driven and rotated by the drive motor (not shown) and gears.

Under the platen 7, a printing head 9, for forming an image on the sheet 3 by transferring ink from a ribbon 11 to the sheet 3, is placed to face the platen 7. In this illustrative embodiment, a so-called line thermal head (including heating elements arranged in a line) is employed as the printing head 9, by which the entire printable range of the sheet 3 is covered by the printing head 9.

Incidentally, the printing head 9 is mounted and fixed on the lower part of the facsimile machine 1 (inside the lower cover 4) together with a ribbon supply part 4*a*, a ribbon roll-up part 4*b*, a CIS (Contact Image Sensor) 25, a document ejection pinch roller 24, a ribbon sensor 31, etc. which will be explained later. Therefore, when the upper cover 2 is opened, the printing head 9 stands still while the platen 7 separates from the printing head 9.

On the downstream side of the platen 7 in the sheet feed path 17, the sheet ejection roller 15 is provided. The sheet ejection roller 15 makes contact with the sheet 3 (after the printing of an image thereon) so as to apply feeding force thereto, by which the sheet 3 is ejected from the facsimile machine 1 to be held in a sheet holding part 62. A sheet ejection pinch roller 16 is placed over the sheet ejection roller 15 to press against the sheet ejection roller 15 so that the sheet 3 passing between the sheet ejection roller 15 and the sheet ejection pinch roller 16 will be sandwiched between the rollers 15 and 16.

As shown in FIG. 5A, the circumferential exterior surface of the sheet ejection roller 15 for making contact with the sheet 3 is provided with two projecting parts (flanges) 15*a* (surrounding the whole circumference of the roller 15) at both ends of the roller 15 in its axial direction. The sheet ejection pinch roller 16, pressing against part of the circumferential exterior surface of the sheet ejection roller 15 between the two projecting parts 15*a*, cooperates with the sheet ejection roller 15 to eject the sheet 3 to the sheet holding part 62.

In this illustrative embodiment, the sheet ejection roller 15 and the sheet ejection pinch roller 16 will be collectively referred to as a "roller mechanism 15, 16".

The sheet ejection roller 15 is also driven and rotated by the drive motor (not shown) and gears.

Between the sheets 3 set in the sheet supply tray 6 and the sheets (3*a*) held in the sheet holding part 62, a sheet feed cover 61 is provided to prevent the sheets (3, 3*a*) in the two parts 6 and 62 from making contact with each other across a wide area.

In this illustrative embodiment, a part of the upper cover 2 (surrounded by a chain line in FIG. 4) covering the top of the sheet feed roller 5 forms a cover member which is placed between a sheet supply side (on which each sheet 3 is fed before printing) and a sheet ejection side (on which each sheet 3 is fed after printing).

On the sheet holding part 62 side of the cover member (the part of the upper cover 2 covering the top of the sheet feed roller 5), first (two in this illustrative embodiment) projecting parts (first ribs) 2*a* are formed in order to let the sheets 3*a* be held in the sheet holding part 62 in a bent shape (substantially in an S-shape). In this illustrative embodiment, the first projecting parts 2*a* are formed integrally with the upper cover 2 (made of resin such as polystyrene) by injection molding.

In this illustrative embodiment, each first projecting part 2*a* is formed substantially in a triangular shape (when seen in an axial direction of the sheet feed roller 5 orthogonal to FIG. 4) to have a round apex P1. As shown in FIG. 1, the first projecting parts 2*a* are formed on the downstream side of the sheet ejection roller 15 in the sheet feed direction, at separate positions in the axial direction of the sheet ejection roller 15 or the sheet ejection pinch roller 16.

When seen in the direction of an arrow A in FIG. 4 (i.e. when seen in the sheet feed direction from the downstream side), the first projecting parts 2*a* are formed at positions shifted from the sheet ejection roller 15 in the axial direction of the sheet ejection roller 15 or the sheet ejection pinch roller 16 (substantially orthogonal to the sheet feed direction).

As shown in FIG. 4, an opposing part 26*a* facing (opposite to) the first projecting parts 2*a* is provided with second projecting parts (second ribs) 2*b* projecting toward the upper cover 2. The second projecting parts 2*b* are formed letting their apexes P2 be placed above an ejecting part P3 of the roller mechanism 15, 16 and below the apexes P1 of the first projecting parts 2*a*, while letting the apexes P2 be situated on the downstream side of the ejecting part P3 and on the upstream side of the apexes P1 in the sheet feed direction.

When seen in the direction of the arrow A in FIG. 4 (i.e. when seen in the sheet feed direction from the downstream side), the second projecting parts 2*b* are formed at positions shifted from the roller mechanism 15, 16 in the axial direction of the roller mechanism 15, 16 (orthogonal to FIG. 4) to be situated on both sides of the roller mechanism 15, 16 in the axial direction as shown in FIG. 1.

The apexes P1 of the first projecting parts 2*a* mean portions of the first projecting parts 2*a* making contact with a stack of sheets 3*a* held in the sheet holding part 62. The apexes P2 of the second projecting parts 2*b* mean portions of the second projecting parts 2*b* making contact with the stack of sheets 3*a* held in the sheet holding part 62. The ejecting part P3 of the roller mechanism 15, 16 means a point of contact of the roller mechanism 15, 16 with the sheet 3 that is the most downstream in the sheet feed direction.

While the point of contact of the sheet ejection roller 15 with the sheet 3 is identical with the point of contact of the sheet ejection pinch roller 16 with the sheet 3 in the roller mechanism 15, 16 of this illustrative embodiment except that the contacting points are on different sides of the sheet 3, in cases where the sheet ejection roller 15 and the sheet ejection pinch roller 16 are shifted from each other in the sheet feed direction, the ejecting part P3 of the roller mechanism 15, 16 is defined as the point of contact of the sheet 3 with one of the rollers 15 and 16 that is on the downstream side in the sheet feed direction (the sheet ejection pinch roller 16, for example).

Further, a base part 62*a* of the sheet holding part 62 (surrounded by a two-dot chain line in FIG. 4), situated on the downstream side of the ejecting part P3, is provided with third projecting parts (third ribs) 2*c* protruding from the base part 62*a*. By the third projecting parts 2*c*, the position of the stack of sheets 3*a* held in the sheet holding part 62 is adjusted so that the sheet 3 ejected from the ejecting part P3 and colliding with the stack of sheets 3*a* (held in the sheet holding part 62) will head in an upward direction. In this illustrative embodiment in which the direction of sheet ejection from the ejecting part P3 is horizontal as shown in FIG. 4, the position of the stack of sheets 3*a* held in the sheet holding part 62 is adjusted by the third projecting parts 2*c* so that a normal line B (see FIG. 4) to the surface 3*b* of a part of the stack of sheets 3*a* facing the ejecting part P3 will point in a direction more upward than the horizontal direction.

Specifically, by letting part of the base part 62*a* of the sheet holding part 62 project toward the ejecting part P3 as above, the position of the bottom of the stack of sheets 3*a* (held on the base part 62*a* of the sheet holding part 62) is adjusted toward the ejecting part P3.

The other side of the opposing part 26*a* is provided with a document tray 26. When a document to be transmitted by the facsimile machine 1 is set in the document tray 26, the document is fed along a document feed path 29 by the ADF roller 21 and the LF roller 23.

Specifically, the document set in the document tray 26 is first fed by the ADF roller 21. Over the ADF roller 21, a separating member 27 is placed. The separating member 27 prevents multiple documents from being fed by the ADF roller 21, by successively letting a lowermost one (fed by the ADF roller 21) of a stack of sheets of the document separate from the rest of the document. Therefore, the document set in the document tray 26 is fed sheet by sheet along the document feed path 29 by the ADF roller 21 in cooperation with the separating member 27.

On the downstream side of the ADF roller 21 in the document feed path 29, the CIS 25 is placed. Over the CIS 25, a document holder 28 is provided so as to press against the top face of the CIS 25. The CIS 25 successively reads an image on each sheet of the document while the sheet fed along the document feed path 29 passes between the CIS 25 and the document holder 28.

On the downstream side of the CIS 25, the LF roller 23 and the document ejection pinch roller 24 (under the LF roller 23) are rotatably placed to press against each other. The LF roller 23 and the document ejection pinch roller 24 eject the document (after the image reading by the CIS 25) from the facsimile machine 1.

The aforementioned keyboard 22, having numeric keys and various function keys, is provided on a top panel 20 of the facsimile machine 1. The user can instruct the facsimile machine 1 to perform various operations by pressing the keys on the keyboard 22. The top panel 20 is also provided with a display unit 20*a* (see FIG. 1) for displaying the operating status of the facsimile machine 1 to the user.

On the lower cover 4, the ribbon supply part 4*a* is formed below the sheet feed roller 5 while the ribbon roll-up part 4*b* is formed below the ADF roller 21. The ribbon supply part 4*a* stores the ribbon 11 which has been rolled up around a ribbon supply spool 12.

The ribbon 11 is pulled out from the ribbon supply part 4*a*, passes between the printing head 9 and the platen 7, and is rolled up by a ribbon roll-up spool 13 of the ribbon roll-up part 4*b*.

Incidentally, both the ribbon supply spool 12 and the ribbon roll-up spool 13 in this illustrative embodiment are attached to a cassette frame (not shown) to form one ribbon cassette, and the ribbon cassette is configured to be attachable and detachable to/from the lower cover 4.

However, such a configuration as a ribbon cassette is only an example, and thus the ribbon supply spool 12 and the ribbon roll-up spool 13 may also be configured to be independently attached and detached to/from the lower cover 4.

The ribbon 11 is made wide enough to cover a printable range of the heating elements of the printing head 9 configured as a line thermal head. The ribbon roll-up spool 13, driven and rotated by the drive motor (not shown) and gears, rolls up the ribbon 11 which has been used for the image formation on the sheet 3.

In the following, the operation of the facsimile machine 1 for feeding the sheet 3 and the characteristics of the facsimile machine 1 of this illustrative embodiment will be described in detail.

Each sheet 3 set in the sheet supply tray 6 is fed by the sheet feed roller 5 to the position between the printing head 9 and the platen 7, at which an image is printed on the sheet 3 (being fed by the platen 7) by the printing head 9 by transferring the ink on the ribbon 11 into the sheet 3.

Meanwhile, the ribbon supply spool 12 and the ribbon roll-up spool 13 are driven and rotated in sync with the rotation of the platen 7, by which the ribbon 11 which has been rolled up around the ribbon supply spool 12 is pulled out and rolled up by the ribbon roll-up spool 13.

The sheet 3, on which the image has been printed by the printing head 9 as above, is guided by feed guide walls 4*c* and 4*d* (see FIG. 4) to change its feed direction by approximately 180 degrees. Thereafter, the sheet 3 is fed by the sheet ejection roller 15 to be ejected toward the upper left of FIG. 4, letting its front end make contact with the upper cover 2 and the first projecting parts 2*a*.

In this operation, also in the facsimile machine 1 (sheet feed device) of this illustrative embodiment, an upper part of the stack of sheets 3*a* held in the sheet holding part 62 can be pulled downward together with a sheet 3 set in the sheet supply tray 6 (due to friction between contacting parts of the sheets 3 and 3*a*) when the sheet 3 is fed by the sheet feed roller 5 to the position between the printing head 9 and the platen 7. However, since the stack of sheets 3*a* in the sheet holding part 62 is held in the bent shape (S-shape) in this illustrative embodiment, only the part bent in the S-shape is deformed to bend further.

Therefore, the sheets 3*a* in the sheet holding part 62 are prevented from curving downward like an arch and flopping to cover the ejecting part P3 even when the sheet feed cover 61 is downsized, such that downsizing of the facsimile machine 1 can be realized.

Figure 6:
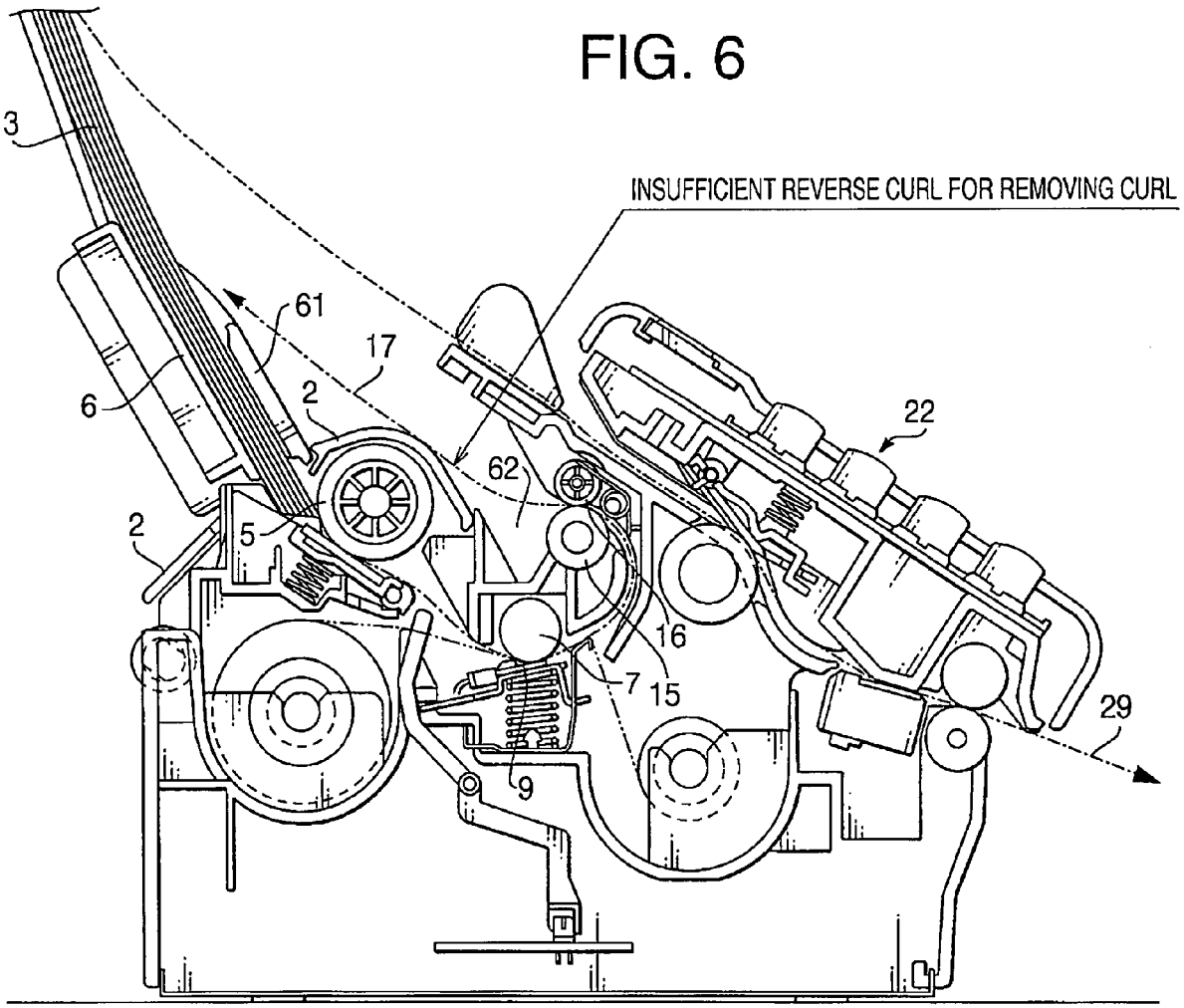
FIG. 6 is a sectional side view explaining a problem occurring to a facsimile machine without first projecting parts in accordance with aspects of the present invention.

Incidentally, if the size of the upper cover 2 is reduced without providing the first projecting parts 2*a* to the upper cover 2, removal of a curl in the sheet can become insufficient since it is impossible as shown in FIG. 6 to continuously cause a reverse curl in the sheet during a period between the collision of the front end of the sheet against the upper cover 2 and the completion of the sheet ejection.

On the other hand, in this illustrative embodiment, a sufficient reverse curl can be caused with the sheet 3*a* being ejected to the sheet holding part 62 (differently from cases where no first projecting part 2*a* is provided) since the reverse curl is caused in the sheet 3*a* not only by the upper cover 2 but also by the first projecting parts 2*a* as shown in FIG. 3. Therefore, it becomes possible to remove the curl in the sheet 3*a* securely while downsizing the upper cover 2.

As described above, by the facsimile machine 1 in accordance with the illustrative embodiment of the present invention, the curl in each sheet ejected from the roller mechanism 15, 16 can be eliminated and the sheets 3*a* held in the sheet holding part 62 can be prevented from curving downward like an arch and flopping, while realizing the downsizing of the sheet feed device and the facsimile machine 1.

The first projecting parts 2*a* in the above illustrative embodiment are formed by letting parts of the upper cover 2 protrude therefrom; therefore, the entire facsimile machine 1 including the upper cover 2 can be designed with high flexibility.

Further, since the first projecting parts 2*a* are formed by letting parts of the upper cover 2 protrude as above, larger internal space of the sheet holding part 62 can be secured compared to other cases (e.g. where the whole upper cover 2 is raised for implementing an equivalent of the first projecting parts 2*a*). Therefore, even when a sheet gets jammed in the sheet holding part 62, the user can easily remove the jammed sheet by reaching a hand into the sheet holding part 62, by which high maintainability is realized.

Figure 7:
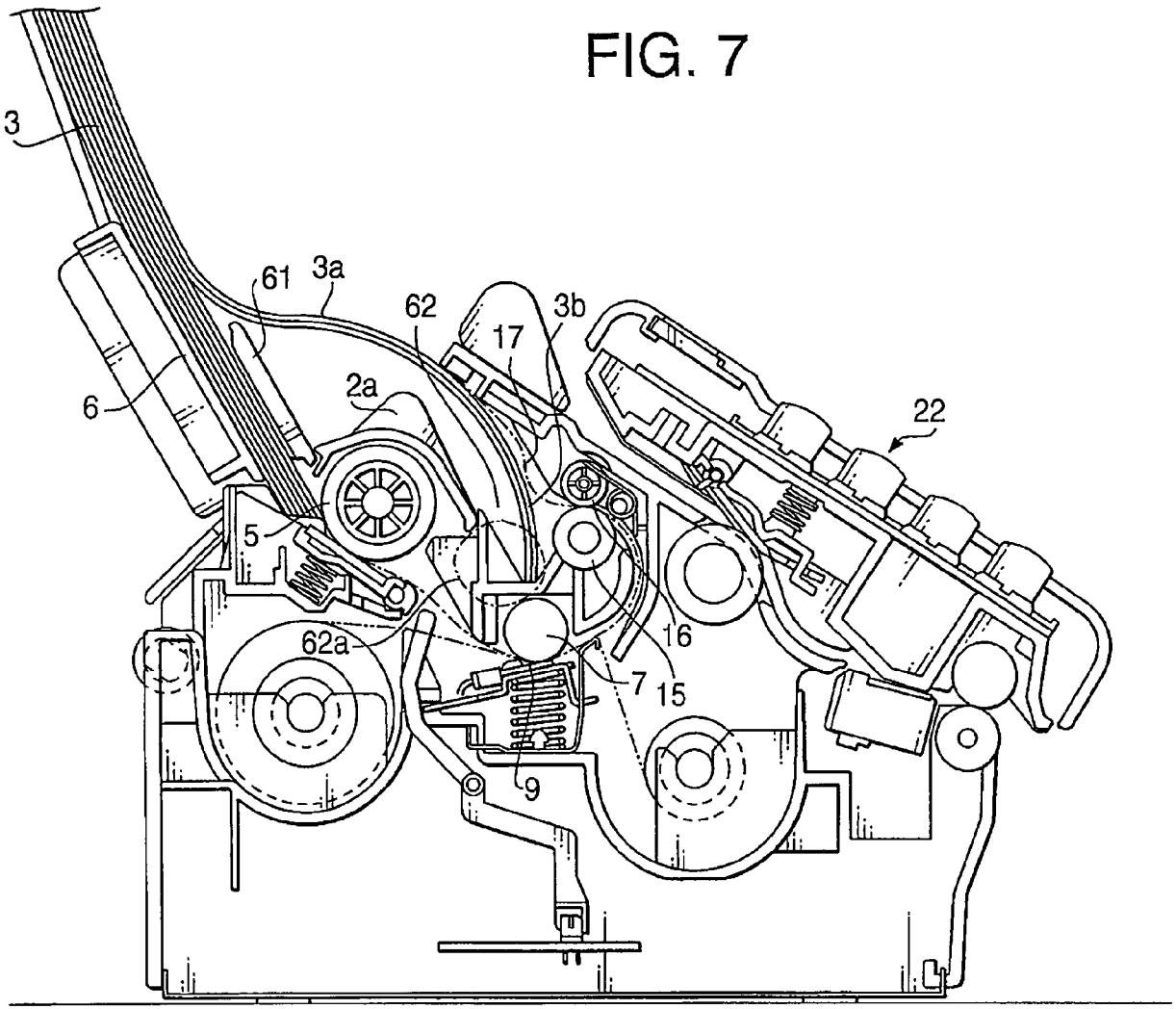
FIG. 7 is a sectional side view explaining a problem occurring to a facsimile machine without second projecting parts in accordance with aspects of the present invention.

Incidentally, when a sheet 3 set in the sheet supply tray 6 is fed by the sheet feed roller 5, the stack of already-ejected sheets 3*a* held in the sheet holding part 62 can be dragged downward by the sheet 3 and thereby bend like an arch making contact with an opposing surface facing the first projecting parts 2*a* as shown in FIG. 7.

Meanwhile, a sheet 3 being ejected from the roller mechanism 15, 16 has to pass between the stack of already-ejected sheets 3*a* held in the sheet holding part 62 and the opposing surface facing the first projecting parts 2*a*. However, when the stack of already-ejected sheets 3*a* bending like an arch is pressing against the opposing surface as above, a strong frictional drag hampers the sheet 3 (a thick chain line in FIG. 7) from being ejected between the stack of arched sheets 3*a* and the opposing surface, by which the sheet 3 can get stuck in the sheet holding part 62 (paper jam).

On the other hand, in the above illustrative embodiment, the opposing part 26*a* facing the first projecting parts 2*a* is provided with the second projecting parts 2*b* projecting toward the upper cover 2 as shown in FIGS. 3 and 4. Therefore, even when the stack of already-ejected sheets 3*a* held in the sheet holding part 62 bends, the stack bends without contacting the whole opposing part 26*a* but contacting the apexes P2 of the second projecting parts 2*b*.

Therefore, the sheet 3 being ejected from the roller mechanism 15, 16 is ejected through a gap formed between the stack of already-ejected sheets 3*a* held in the sheet holding part 62 and the opposing part 26*a* having the second projecting parts 2*b*. Since the second projecting parts 2*b* are formed to protrude from limited area of the opposing part 26*a*, the frictional drag during the ejection of the sheet 3 gets smaller compared to the case where the stack of arched sheets 3*a* presses against the whole opposing part 26*a*, by which the sheet 3 can be ejected smoothly.

Further, since the second projecting parts 2*b* are placed at positions shifted from the roller mechanism 15, 16 substantially in the axial direction of the roller mechanism 15, 16 when seen in the sheet feed direction from the downstream side of the apexes P1 of the first projecting parts 2*a*, the roller mechanism 15, 16 has no obstacle (applying a frictional drag or feeding resistance to the sheet 3 being ejected) in the direction of the feeding force applied to the sheet 3 (i.e. on a line directly extending from the roller mechanism 15, 16 in the sheet feed direction). Therefore, the feeding force of the roller mechanism 15, 16 can be utilized efficiently and the sheet 3 can be ejected securely.

Furthermore, since the second projecting parts 2*b* are placed on both sides of the roller mechanism 15, 16 (in its axial direction) when seen in the sheet feed direction from the downstream side of the apexes P1 of the first projecting parts 2*a*, a rotation moment occurring at a contacting part of one second projecting part 2*b* on one side of the roller mechanism 15, 16 due to feeding resistance can be canceled by a rotation moment occurring at a contacting part of the other second projecting part 2*b* on the other side of the roller mechanism 15, 16 due to feeding resistance. Therefore, the sheet 3 being ejected from the roller mechanism 15, 16 is prevented from being ejected obliquely (deviating from the line directly extending from the roller mechanism 15, 16 in the sheet feed direction).

In addition, by providing the document tray 26 to the other side of the opposing part 26*a* (opposite to the second projecting parts 2*b*), a facsimile machine 1 of beautiful design can be realized while reducing its size.

Figure 8:
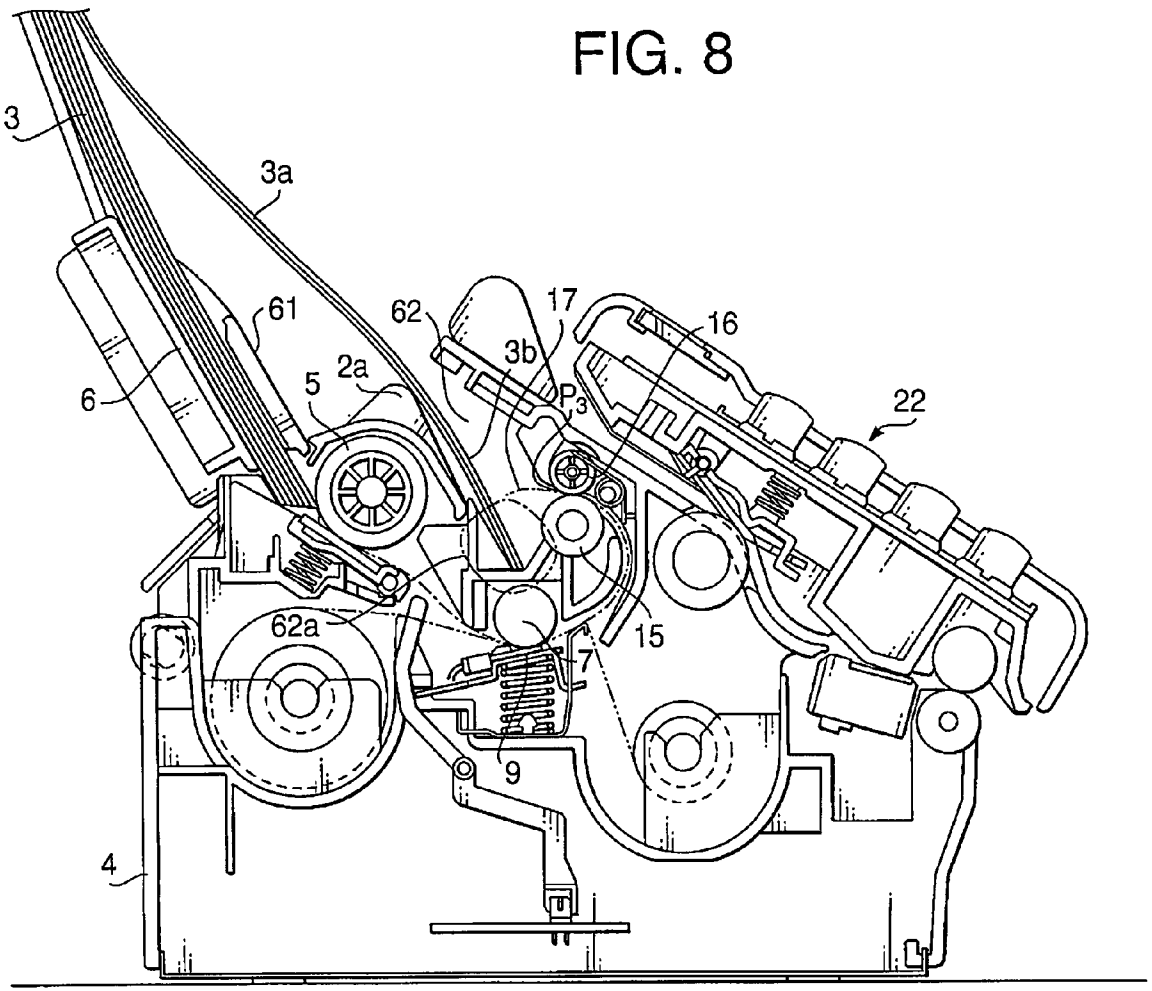
FIG. 8 is a sectional side view explaining a problem occurring to a facsimile machine without third projecting parts in accordance with aspects of the present invention.

Incidentally, if the surface 3*b* of the stack of sheets 3*a* (held in the sheet holding part 62) facing the ejecting part P3 becomes substantially orthogonal to the direction of sheet ejection from the ejecting part P3 as shown in FIG. 8 due to the bending of the stack of sheets 3*a*, the sheet 3 being ejected from the ejecting part P3 is likely to head for the base part 62*a* of the sheet holding part 62 (downward in FIG. 8) and result in a paper jam.

On the other hand, in the above illustrative embodiment, the base part 62*a* of the sheet holding part 62 is provided with the third projecting parts 2*c* which adjusts the position of the stack of sheets 3*a* held in the sheet holding part 62 so that the sheet 3 ejected from the ejecting part P3 and colliding with the stack of sheets 3*a* will head in an upward direction (e.g. so that the normal line B to the surface 3*b* of the stack of sheets 3*a* facing the ejecting part P3 will point in a direction more upward than the horizontal direction in the case where the direction of sheet ejection from the ejecting part P3 is horizontal) as shown in FIG. 4. Therefore, the sheet 3 ejected from the ejecting part P3 and colliding with the surface 3*b* facing the ejecting part P3 can securely be guided upward inside the sheet holding part 62, by which the sheet 3 can be securely prevented from heading for the base part 62*a* of the sheet holding part 62 and resulting in a paper jam.

In the above illustrative embodiment, the position of the stack of sheets 3*a* held in the sheet holding part 62 is adjusted (so as to prevent the paper jam) by the third projecting parts 2*c* formed to protrude from limited parts of the sheet holding part 62, by which larger internal space of the sheet holding part 62 can be secured compared to other cases (e.g. where the whole base part 62*a* of the sheet holding part 62 is raised for realizing the adjustment of the position of the stack of sheets 3*a*). Therefore, the paper jam in the sheet holding part 62 can be prevented without requiring excessive maintenance, allowing the user to easily remove a jammed sheet by reaching a hand into the sheet holding part 62 even in case of a paper jam.

The sheet 3 being ejected from the roller mechanism 15, 16 has a tendency to bend downward due to terrestrial gravitation, and the tendency is enhanced as the sheet 3 gets thinner or softer. The downward bending of the sheet 3 ejected from the roller mechanism 15, 16 causes the sheet feeding to the base part 62*a* of the sheet holding part 62 and results in a paper jam.

On the other hand, in the above illustrative embodiment, since the circumferential exterior surface of the sheet ejection roller 15 for making contact with the sheet 3 is provided with the two projecting parts 15*a* (surrounding the whole circumference of the roller 15) at both ends of the roller 15 in its axial direction, the sheet 3 ejected from the roller mechanism 15, 16 is curved in a shape like "V" or "U" when seen in the sheet feed direction as shown in FIGS. 9A and 9B, by which stiffness of the sheet 3 against the force (terrestrial gravitation) bending the sheet around the axial direction of the roller mechanism 15, 16 is increased.

By the increase of the stiffness, the sheet 3 being ejected from the roller mechanism 15, 16 is prevented from bending downward, by which the sheet 3 is securely guided and fed upward in the sheet holding part 62 and the paper jam can be prevented from occurring.

While a description has been given above of an illustrative embodiment in accordance with the present invention, the present invention is not to be restricted by the particular illustrative embodiment and a variety of modifications, design changes, etc. are possible without departing from the scope and spirit of the present invention described in the appended claims.

For example, while the first projecting parts 2*a* in the above illustrative embodiment are implemented by ribs protruding from limited areas of the aforementioned cover member (the part of the upper cover 2 covering the top of the sheet feed roller 5), it is also possible, for example, to form one first projecting part 2*a* (as a projecting surface) by letting substantially the whole surface of the cover member on the sheet holding part 62 side project into the sheet holding part 62.

While the third projecting parts 2*c* in the above illustrative embodiment are implemented by ribs protruding from limited areas of the base part 62*a* of the sheet holding part 62, it is also possible, for example, to form one third projecting part 2*c* (as a projecting surface) by letting substantially the whole surface of the base part 62*a* project into the sheet holding part 62.

While the first projecting parts 2*a*, the second projecting parts 2*b* and the third projecting parts 2*c* in the above illustrative embodiment are implemented by ribs formed integrally with the upper cover 2, etc., it is also possible, for example, to manufacture the projecting parts 2*a*, 2*b* and 2*c* separately from the upper cover 2, etc. and thereafter fix the projecting parts 2*a*, 2*b* and 2*c* on the upper cover 2, etc. with adhesives, screws, etc.

While the second projecting parts 2*b* in the above illustrative embodiment are placed on both sides of the roller mechanism 15, 16 (in its axial direction) when seen in the sheet feed direction from the downstream side of the apexes P1 of the first projecting parts 2*a*, the arrangement of second projecting parts 2*b* is not restricted to that in the above illustrative embodiment, as long as one or more second projecting parts 2*b* are placed at positions shifted from the roller mechanism 15, 16 in the axial direction of the roller mechanism 15, 16 when seen in the sheet feed direction from the downstream side of the apexes P1 of the first projecting parts 2*a*.

While only one sheet ejection roller 15 is employed in the above illustrative embodiment, two more sheet ejection rollers 15 may be employed in the facsimile machine 1 or the sheet feed device.

While the sheet ejection pinch roller 16 substantially in a cylindrical shape is employed as a member pressing against the sheet ejection roller 15 for pinching and guiding the sheet 3, the sheet ejection pinch roller 16 may be replaced with wall-like ribs for regulating the feed direction of the sheet 3.

While the sheet feed device in accordance with the present invention is applied to a facsimile machine in the above illustrative embodiment, the present invention is applicable not only to facsimile machines but also various types of image formation devices (printers, copiers, etc.) and various other devices executing a prescribed process by feeding sheets.

What is claimed is:

1. A sheet feed device, comprising:

a sheet supply tray in which sheets to be fed are stored;

a roller mechanism configured to eject each sheet after being printed on;

a sheet holding part configured to hold each printed sheet ejected by the roller mechanism; and a cover member which is placed between a sheet supply side on which each sheet is fed before printing and a sheet ejection side on which each sheet is fed after printing, wherein each sheet supplied from the sheet supply tray changes its sheet feed direction approximately 180 degrees before being ejected to the sheet holding part, and wherein part of the cover member on a side of the sheet holding part is provided with a first projecting part which allows the ejected sheets to be held in the sheet holding part while being bent substantially in an S-shape.

2. The sheet feed device according to claim 1, wherein part of an opposing part opposing the first projecting part is provided with a second projecting part projecting toward the cover member, and wherein an apex of the second projecting part is placed above an ejecting part, defined as a point of contact of the sheet with the roller mechanism that is the most downstream in the sheet feed direction, and below an apex of the first projecting part.

3. The sheet feed device according to claim 2, wherein the second projecting part is placed at a position away from the roller mechanism substantially in an axial direction of the roller mechanism when viewed from the apex of the first projecting part in the sheet feed direction.

4. The sheet feed device according to claim 3, wherein a plurality of the second projecting parts is placed on both sides of the roller mechanism in the axial direction of the roller mechanism when viewed from the apex of the first projecting part in the sheet feed direction.

5. The sheet feed device according to claim 2, wherein the second projecting part is placed on a downstream side of the roller mechanism in the sheet feed direction and on an upstream side of the first projecting part in the sheet feed direction.

6. The sheet feed device according to claim 2, wherein a base part of the sheet holding part is placed below the ejecting part, and wherein the base part of the sheet holding part is provided with a holding position adjusting member which adjusts a position of a stack of sheets held in the sheet holding part so that each sheet ejected from the ejecting part and colliding with the stack of sheets will head in an upward direction.

7. The sheet feed device according to claim 6, wherein the holding position adjusting member adjusts the position of the stack of sheets held in the sheet holding part so that each sheet ejected from the ejecting part and colliding with the stack of sheets will head in an upward direction by adjusting a position of a bottom of the stack of sheets held on the base part of the sheet holding part toward the ejecting part.

8. The sheet feed device according to claim 6, wherein the holding position adjusting member includes a third projecting part protruding from part of the base part of the sheet holding part.

9. The sheet feed device according to claim 1, wherein the roller mechanism includes:

an ejection roller which is configured to make contact with the sheet and apply feeding force to the sheet; and a pinch guide member which is configured to oppose the ejection roller via the sheet, wherein:

a circumferential exterior surface of the ejection roller for making contact with the sheet is provided with projecting parts, surrounding the whole circumference of the ejection roller, at both ends of the ejection roller in its axial direction.

10. The sheet feed device according to claim 9, wherein the pinch guide member is a sheet ejection pinch roller which is configured to press against the ejection roller.

11. A sheet feed device, comprising:

a sheet supply tray in which sheets to be fed are stored;

a roller mechanism configured to eject each sheet after being printed on;

a sheet holding part configured to hold each printed sheet ejected by the roller mechanism; and a cover member which is placed between a sheet supply side on which each sheet is fed before printing and a sheet ejection side on which each sheet is fed after printing, wherein:

each sheet supplied from the sheet supply tray changes its sheet feed direction approximately 180 degrees before being ejected to the sheet holding part, and a face of the cover member on a side of the sheet holding part is provided with a first projecting part which allows the ejected sheets to be held in the sheet holding part while being bent substantially in an S-shape, and part of an opposing part opposing the first projecting part is provided with a second projecting part projecting toward the cover member, and an apex of the second projecting part is placed above an ejecting part, defined as a point of contact of the sheet with the roller mechanism that is the most downstream in the sheet feed direction, and below an apex of the first projecting part.

12. A sheet feed device, comprising:

a sheet supply tray in which sheets to be fed are stored;

a roller mechanism configured to eject each sheet after a prescribed process;

a sheet holding part configured to hold each sheet ejected by the roller mechanism; and a cover member which is placed between a sheet supply side on which each sheet is fed before the prescribed process and a sheet ejection side on which each sheet is fed after the prescribed process, wherein:

each sheet supplied from the sheet supply tray changes its sheet feed direction approximately 180 degrees before being ejected to the sheet holding part, and part of the cover member on a side of the sheet holding part is provided with a first projecting part which allows the ejected sheets to be held in the sheet holding part while being bent substantially in an S-shape.

13. An image formation device including a sheet feed device, comprising:

a sheet supply tray in which sheets to be fed are stored;

a roller mechanism configured to eject each sheet after image formation;

a sheet holding pat configured to hold each sheet ejected by the roller mechanism; and a cover member which is placed between a sheet supply side on which each sheet is fed before image formation and a sheet ejection side on which each sheet is fed after image formation, wherein:

each sheet supplied from the sheet supply tray changes its sheet feed direction approximately 180 degrees before being ejected to the sheet holding part, and part of the cover member on a side of the sheet holding part is provided with a first projecting part which allows the ejected sheets to be held in the sheet holding part while being bent substantially in an S-shape.

14. The image formation device according to claim 13, wherein part of an opposing part opposing the first projecting part is provided with a second projecting part projecting toward the cover member, and wherein an apex of the second projecting part is placed above an ejecting part, defined as a point of contact of the sheet with the roller mechanism that is the most downstream in the sheet feed direction, and below an apex of the first projecting part.

15. The image formation device according to claim 14, wherein a base part of the sheet holding part is placed below the ejecting part, and wherein the base part of the sheet holding part is provided with a holding position adjusting member which adjusts a position of a stack of sheets held in the sheet holding part so that each sheet ejected from the ejecting part and colliding with the stack of sheets will head in an upward direction.

16. The image formation device according to claim 14, further comprising a document tray for holding a document, the document tray opposing a side of the opposing part opposite to a side oft e opposing part including the second projecting part, wherein the image formation device is a facsimile machine.

* * * * *